US008733503B2

(12) United States Patent
Spencer

(10) Patent No.: US 8,733,503 B2
(45) Date of Patent: May 27, 2014

(54) SAFETY ATTACHMENT FOR LADDER

(76) Inventor: Richard David Spencer, Winfield, WV (US)

( * ) Notice: Subject to any disclaimer, the term of this patent is extended or adjusted under 35 U.S.C. 154(b) by 44 days.

(21) Appl. No.: 13/420,639

(22) Filed: Mar. 15, 2012

(65) Prior Publication Data

US 2012/0234628 A1 Sep. 20, 2012

Related U.S. Application Data

(60) Provisional application No. 61/452,678, filed on Mar. 15, 2011.

(51) Int. Cl.
*E06C 7/42* (2006.01)

(52) U.S. Cl.
USPC ..... 182/107

(58) Field of Classification Search
USPC ..... 182/107, 108, 109, 111, 171; D25/68
See application file for complete search history.

(56) References Cited

U.S. PATENT DOCUMENTS

| | | | | |
|---|---|---|---|---|
| 3,933,221 | A | 1/1976 | Sorenson | |
| 4,207,886 | A | 6/1980 | Sorenson | |
| 4,660,794 | A * | 4/1987 | Given | 248/238 |
| 5,337,856 | A * | 8/1994 | Fillers | 182/107 |
| 6,158,551 | A * | 12/2000 | Gray | 182/107 |
| 6,382,353 | B2 | 5/2002 | Laug | |
| 6,527,084 | B2 | 3/2003 | Hrincu | |
| 6,672,427 | B1 | 1/2004 | Sheffield | |
| 6,688,426 | B1 | 2/2004 | Mikros | |
| 7,757,814 | B2 | 7/2010 | Pleadwell et al. | |
| 2008/0000720 | A1 | 1/2008 | Porch | |
| 2008/0190692 | A1 * | 8/2008 | Feik | 182/107 |
| 2009/0314579 | A1 | 12/2009 | Withers | |
| 2010/0038172 | A1 | 2/2010 | Ralston | |
| 2010/0300805 | A1 | 12/2010 | Moss et al. | |

* cited by examiner

*Primary Examiner* — Charles A Fox
*Assistant Examiner* — Kristine Florio
(74) *Attorney, Agent, or Firm* — Dinsmore & Shohl, LLP; Monika J. Hussell, Esq.

(57) ABSTRACT

An extension ladder stabilizer includes a ladder rung engagement rod having threads along at least a portion of its length and configured to be disposed in and project from each end of a hollow tubular rung of an extension ladder, a pair of internal supports having a substantially gear shaped hole in each, a pair of external supports having a substantially gear shaped boss with a through hole on a first face and an anchor channel on a second face opposite the first face on each, and a pair of ground engagement members. In a ladder stabilizing configuration, the extension ladder stabilizer is installed on a ladder and the ground engagement members are passed through the anchor channels and into the ground to secure the ladder from side slipping, kicking back, and kicking over when in use.

20 Claims, 7 Drawing Sheets

SAFETY ATTACHMENT FOR LADDER

CROSS-REFERENCE TO RELATED APPLICATIONS

This application claims the benefit of U.S. Provisional Patent Application No. 61/452,678 filed Mar. 15, 2011, entitled SAFETY ATTACHMENT FOR LADDER, the disclosure of which is incorporated by reference herein in its entirety.

FIELD

The present invention relates generally to an apparatus for stabilizing a ladder, and more particularly to a ladder stabilizing apparatus to prevent or reduce side slipping, kick back, and kick over of a ladder when in use.

BACKGROUND

Injuries and accidents are prevalent worldwide as a result of falls from ladders. The cost to an individual who suffers a fall from a ladder is tremendous. There is not only a financial burden from medical expenses and lost wages as a result of injury, but also the emotional cost of pain and suffering. The cost of ladder fall accidents is also transferred to uninvolved parties if the fall results in a death or life-altering injury of a family or community member. A ladder fall in the workplace also has detrimental impacts in the areas of loss time, workers' compensation claims and increased insurance rates for both the injured party and the employer.

A spotter or helper can be used to help prevent ladder fall accidents. For example, an assistant can hold the bottom of the ladder to try and stop the base of a ladder from moving. Thus, a person can use the ladder knowing that someone is holding the bottom of the ladder and lessening the likelihood that the ladder will shift or topple. Accidents due to ladders slipping or moving relative to the ground while in use are less likely when someone is holding the ladder to stop it from moving but does not completely eliminate the danger. Additionally, supplemental manpower is not always available to have a spotter or helper assist in holding the base of the ladder while in use. Requiring a person to hold the ladder also decreases the productivity of the project worksite as the individual holding and stabilizing the ladder is unable to actively contribute to the advancement of the project while securing the ladder.

Utilization of a spotter or helper to secure the base of a ladder while in use is also not a solution to the problem. The safety of the individual on the ladder is limited to the spotter's ability to retain the ladder in a safe position. As the individual on the ladder leans to the side or back while ascending, descending, or working on the ladder their weight shifts and the ladder may shift as well resulting in the ladder falling and injury to the individual on the ladder. Once a ladder begins to shift, it becomes very challenging for a spotter or helper to prevent the ladder from completely toppling.

A ladder stabilizing solution which provides support for the ladder and prevention of the ladder from shifting sideways, kicking back, and kicking over is desirable. It is also desirable to prevent loss time accidents, have lower workers' compensation rates, retain trained employees on the job, and maintain lower insurance premiums.

SUMMARY

An embodiment of the present disclosure is generally directed toward an extension ladder stabilizer which includes a ladder rung engagement rod having threads along at least a portion of its length and configured to be disposed in and project from each end of a hollow tubular rung of an extension ladder, a pair of internal supports having a substantially gear shaped hole in each internal support, a pair of external supports having a substantially gear shaped boss with a through hole on a first face and an anchor channel on a second face opposite the first face on each external support, and a pair of ground engagement members. In a ladder stabilizing configuration, the extension ladder stabilizer is installed on a ladder with the substantially gear shaped boss disposed in the substantially gear shaped hole and the ground engagement members passed through the anchor channels and into the ground to secure the ladder from side slipping, kicking back, and kicking over when in use. The shapes of the substantially gear shaped hole and substantially gear shaped boss allow their engagement at multiple positions of relative rotation.

A further embodiment of the present disclosure is generally directed toward an extension ladder stabilizer which includes a pair of internal supports having a substantially gear shaped hole, a pair of external supports having a substantially gear shaped boss with a through hole on a first face and an anchor channel on a second face opposite the first face on each external support, and a pair of ground engagement members. The first of the pair of internal supports and the first of the pair of external supports are configured to be affixed to a ladder by means of a nut secured to the end of a first bolt passed through an orifice in the side rail of the ladder and tightly abutted against the first external support or a washer and the second of the pair of internal supports and the second of the pair of external supports are configured to be affixed to the ladder by means of a second nut secured to the end of a second bolt passed through an orifice in the side rail of the ladder and tightly abutted against the second external support or a washer.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
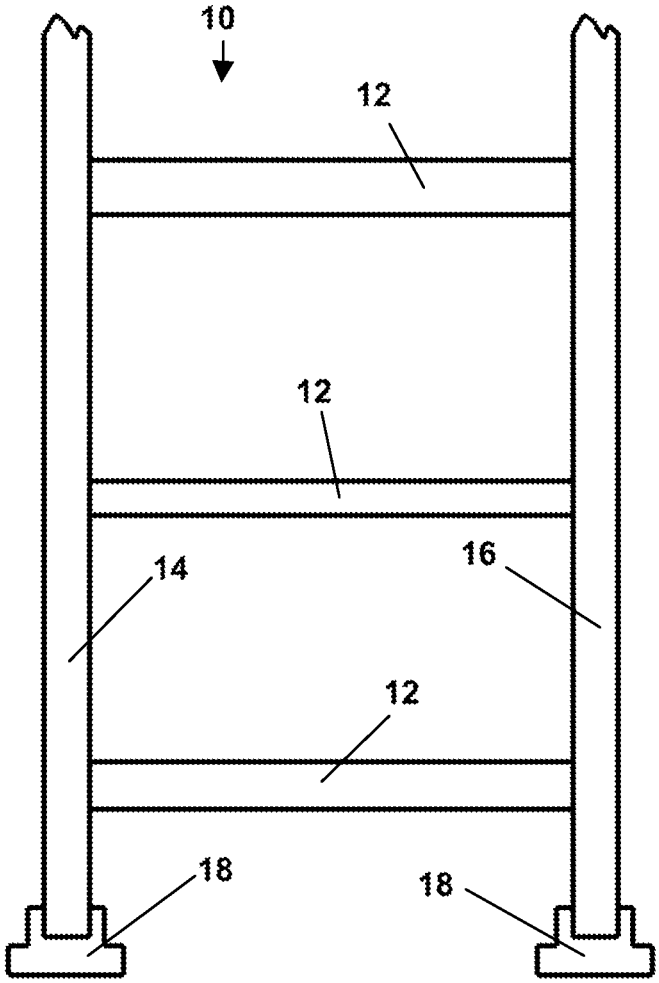
PRIOR ART FIG. 1
FIG. 1 is a schematic view of a prior art ladder.

This invention is directed toward an apparatus for stabilizing a ladder. More specifically, the invention is a ladder stabilizer which anchors the bottom of a ladder to the ground to prevent or reduce side slipping, kick back, and kick over of the ladder when in use. The ladder stabilizer is generally denoted by the reference numeral "100". It is envisioned that the ladder stabilizer 100 may be utilized by professionals as well as individual home owners Referring to FIG. 1, a schematic view of a generic ladder 10. Ladders 10 are generally comprised of a series of horizontal members or rungs 12 which act as steps when the ladder is in use. The rungs 12 are generally hollow tubular members. Ladders 10 also generally comprise a pair of side rails 14, 16 which the rungs 12 span between. Ladders 10 also may have foot pads 18 which provide traction between the ladder and the surface it rests upon as well as spread the load of the ladder out upon a larger surface contact area than the ends of the side rails 14, 16. Ladders 10 are commonly available in a variety of widths with non-limiting examples including 19.5 inches, 19 inches, 18.5 inches, 17.5 inches, and 17 inches.

Figure 2:
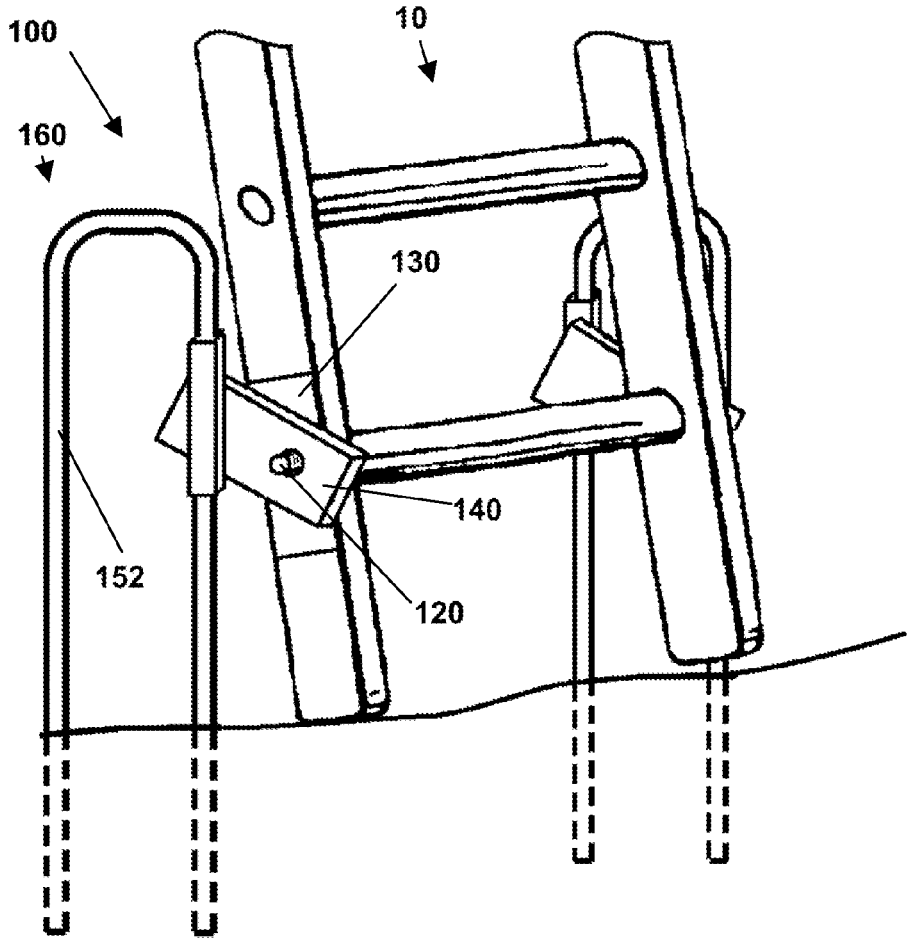
FIG. 2 is a perspective view of an embodiment of the invention on a prior art ladder.

Referring to FIG. 2, a perspective view of an embodiment of the present invention. It should be understood that the ladder 10 shown is a non-limiting example of a ladder. The ladder stabilizer 100 comprises a ladder rung engagement rod 120, a pair of internal supports 130, a pair of external supports 140, and a pair of ground engagement members 160.

In an embodiment of the present invention, the ladder rung engagement rod 120 comprises threads 122 along at least a portion of the length of the ladder rung engagement rod and is sized to project from each end of a rung 12 of a ladder 10. In a selected embodiment, the threads 122 are disposed along the entire length of the ladder rung engagement rod 120. In another selected embodiment, the threads 122 are disposed only at the ends of the ladder rung engagement rod 120. In embodiments where the threads 122 are only disposed at the ends, the threads preferably extend for at least 2 inches, more preferably for at least 3 inches, and even more preferably for at least 4 inches from each end. Alternatively, in embodiments where the threads 122 are only disposed at the ends, the threads may be disposed along the entire length of the ladder rung engagement rod 120 except a central unthreaded portion approximately equal to or less than the width of the ladder 10 to which the ladder stabilizer 100 is to be installed.

Figure 3A:
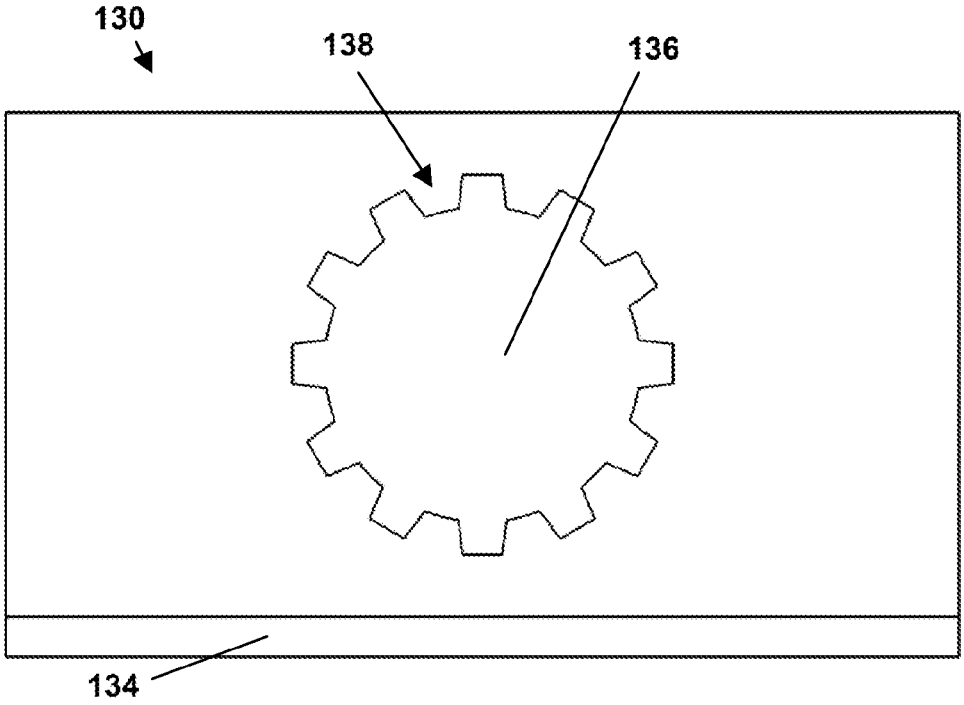
FIG. 3*a* is a front view of the internal support of an embodiment of the invention.
Figure 3B:
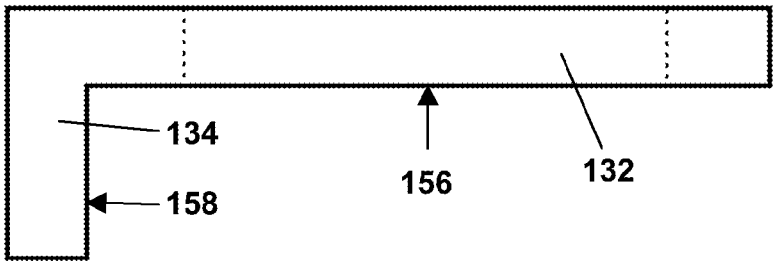
FIG. 3*b* is a top view of the internal support of an embodiment of the invention.

Referring now to FIGS. 3*a* and 3*b*, a front view and top view of the internal support 130. The ladder stabilizer 100 comprises a pair of internal supports 130 which individually interface with the side rails 14, 16 of a ladder 10. In a selected embodiment of the invention the internal support 130 is substantially L-shaped with an internal support side plate 132 and an internal support back plate 134. The internal support side plate 132 is disposed on the outside face of the side rails 14, 16 opposite the face where the rungs 12 are affixed, with the internal support side plate inner face 156 abutted against the side rails. The internal support back plate 134 is disposed on the back face of the side rails 14, 16 with the internal support back plate inner face 158 abutted against the side rails. It is envisioned that the internal support back plate 134 may also be disposed on the front face of the side rails 14, 16. It is further envisioned that the internal support back plate 134 may be duplicated to abut against both the front face and back face of the side rails 14, 16 yielding a channel-shaped internal support 130.

In an embodiment of the present invention, the internal support side plates 132 are preferably sized to span across the width of the side rails 14, 16 of the ladder 10. Sizing the internal support side plates 132 to span across the width of the side rails 14, 16 allows the internal support side plates to rest on the side rails even when the side rails are channel side rails.

In an embodiment of the present invention, the internal support back plates 134 are not present and the internal support side plates 132 are sized to be disposed within the outside channel of a side rail 14, 16 with channels.

In an embodiment of the present invention, the internal supports 130 comprise a substantially gear shaped hole 136. The substantially gear shaped hole 136 is disposed on the internal support side plate 132. The substantially gear shaped hole 136 is preferably located at the center of the internal support side plate 132, but may be centered at any point along longitudinal axis of the internal support side plate. The longitudinal axis of the internal support side plate 132 is the axis parallel to the line formed by the junction of the internal support side plate and the internal support back plate 134.

Figure 4A:
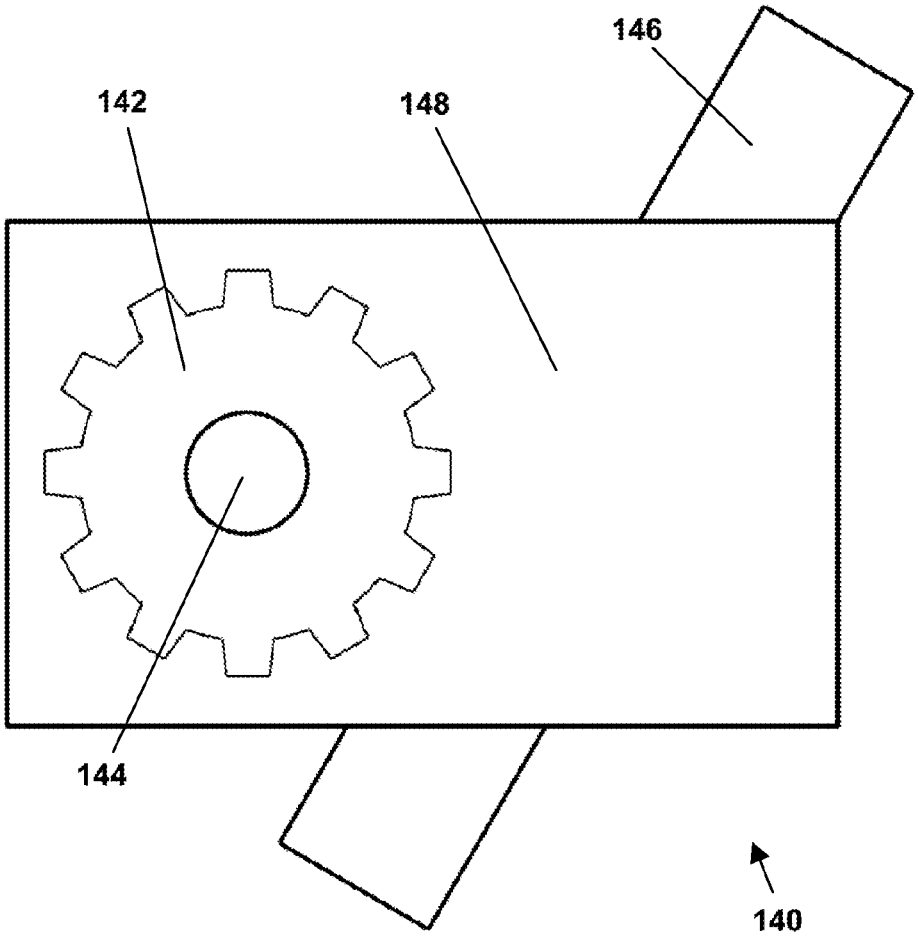
FIG. 4*a* is a front view of the external support of an embodiment of the invention.

The substantially gear shaped hole 136 may comprise any geometry which comprises a series of repeating equally spaced protuberances or teeth 138 around the periphery of the substantially gear shaped hole. While isosceles trapezoidal shaped teeth 138 are explicitly disclosed in FIG. 3*a*, other geometries are equally envisioned such as a crenellated geometry. Further, non-limiting geometries for the teeth 138 include isosceles triangles, rectangles, and parabolic segments. The substantially gear shaped hole 136 preferably comprises teeth 138 spaced approximately 15 to approximately 60 degrees apart, more preferably spaced approximately 20 to approximately 45 degrees apart, and even more preferably spaced approximately 24 to approximately 36 degrees apart. In a preferred embodiment, the teeth 138 are distributed around the entire periphery of the substantially gear shaped hole 136 as shown in FIG. 4*a*. In another selected embodiment, not shown, the teeth 138 may be only distributed around a portion of the substantially gear shaped hole 136; non-limiting examples include, distributed around approximately 180 degrees, approximately 120 degrees, or approximately 90 degrees.

In a selected embodiment of the present invention, the internal support 130 is approximately ¼ inch thick, the internal support side plate inner face 156 is preferably approximately 6 inches by approximately 3 inches, the internal support back plate inner face 158 is preferably approximately ¾ to 1 inch by approximately 6 inches, and the substantially gear shaped hole 136 is preferably centered on the internal support side plate inner face 156.

The substantially gear shaped hole 136 may be generated using a water jet cutter. A jet of water at high velocity and pressure is sprayed onto the internal support 130 to penetrate the internal support's material and cut the substantially gear shaped hole 136. The portion of the material removed from the internal support 130 when the substantially gear shaped hole 136 is generated using a water jet cutter has the same shape as the substantially gear shaped hole and is called a blank. The water jet cutter also removes a thin band of material where the water jet contacts the internal support 130 thus creating a blank which is the same geometry as the substantially shaped hole 136 but of a slightly reduced size.

Figure 4B:
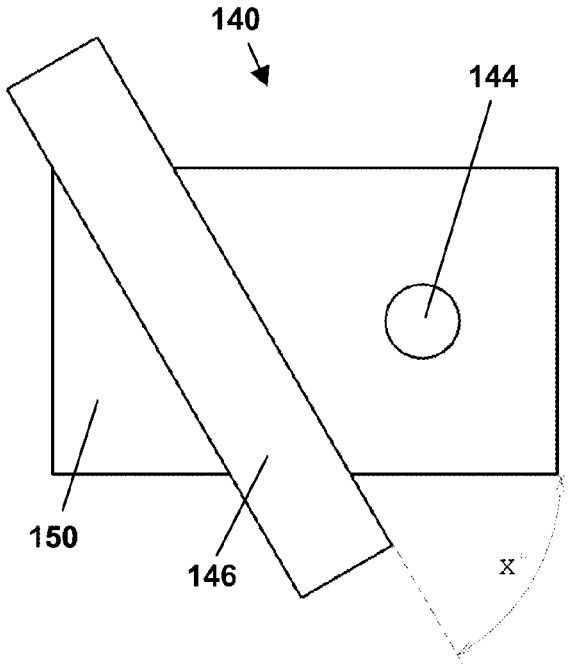
FIG. 4*b* is a back view of the external support of an embodiment of the invention from the opposite perspective as FIG. 4*a*.
Figure 4C:
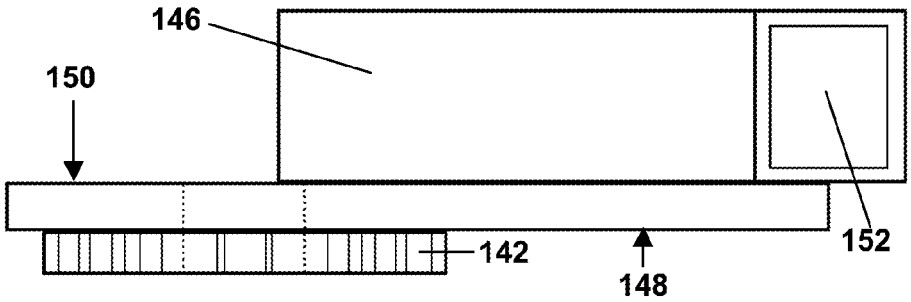
FIG. 4*c* is a top view of the external support of an embodiment of the invention.
Figure 5A:
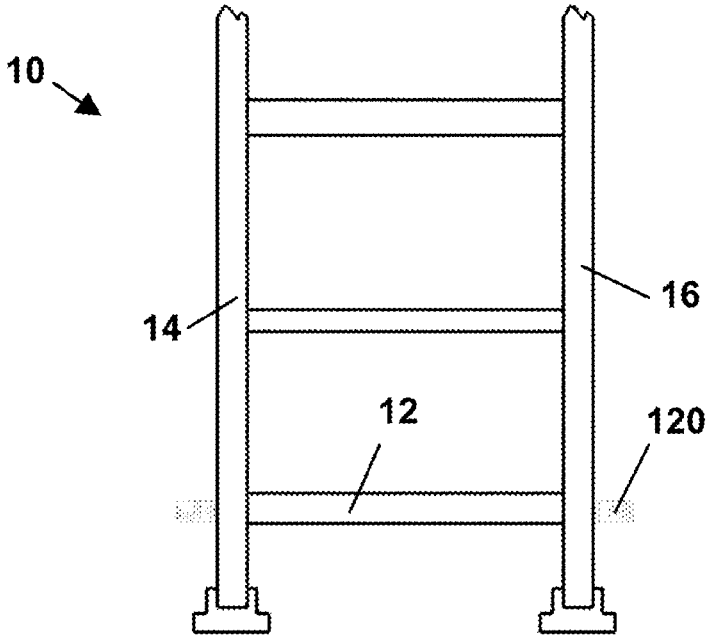
FIGS. 5*a*-5*d* are schematic illustrations of the extension ladder stabilizer of an embodiment of the invention at progressive points of installation on a generic extension ladder.
Figure 5B:
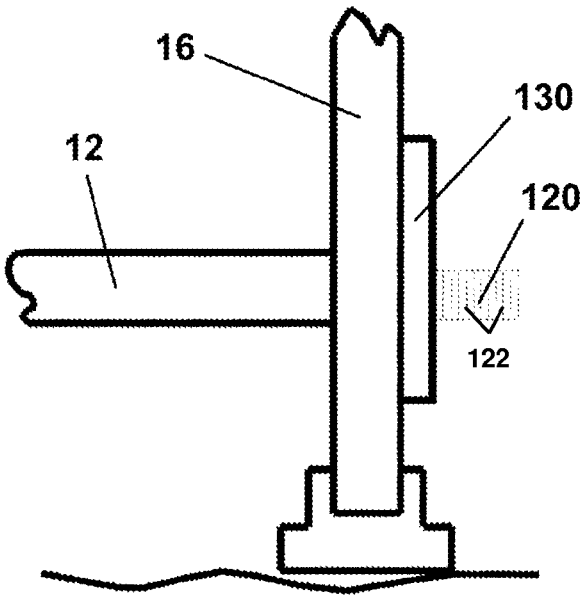
Figure 5C:
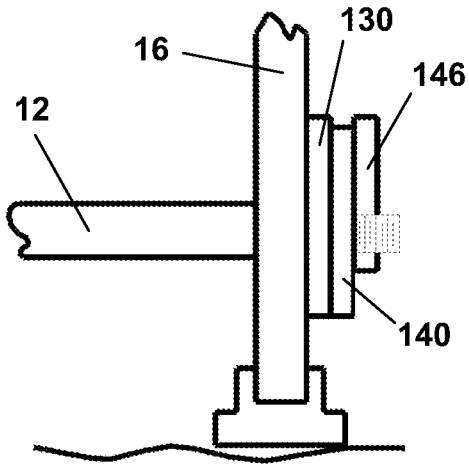
Figure 5D:
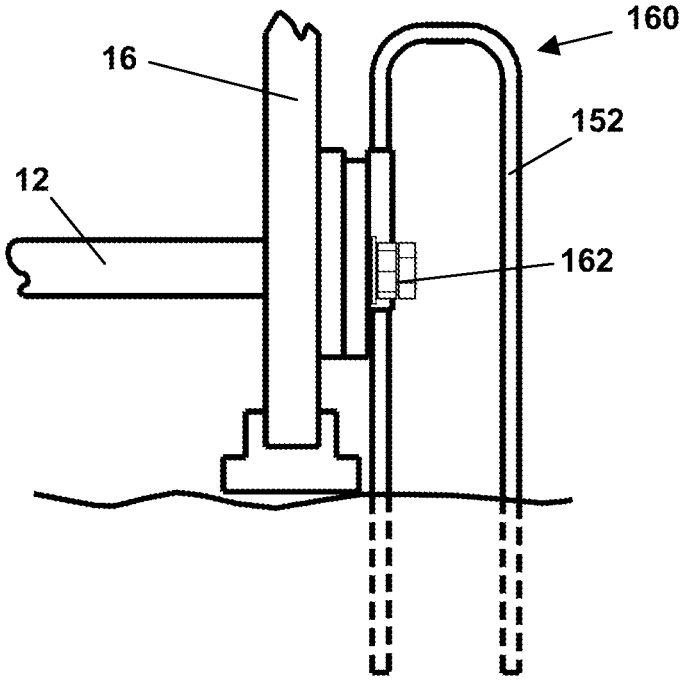

Referring to FIG. 4*a*, a front view of the external support 140, FIG. 4*b*, a back view of the external support, and FIG. 4*c*, a top view of the external support. The external supports 140 each comprise a substantially gear shaped boss 142 on a first face 148, a ladder rung engagement rod pass-through hole 144 located substantially in the center of the substantially gear shaped boss, and an anchor channel 146 disposed on a second face 150 opposite the first face.

In an embodiment of the present invention, the substantially gear shaped boss 142 is preferably the same geometry as the substantially gear shaped hole 136. In an embodiment of the present invention, the substantially gear shaped boss 142 is formed by adhering the blank generated by water jet cutting the substantially gear shaped hole 136 from each of the internal supports 130 to the first face 148 of each of the respective external supports 140. The water jet cutting operation results in a substantially gear shaped boss 142 of the same geometry as the substantially gear shaped hole 136 wherein the substantially gear shaped boss is scaled down slightly as a result of the material removed by the water jet. The slightly reduced size allows the substantially gear shaped boss 142 to easily be disposed within the substantially gear shaped hole 136. Non-limiting methods of adhering the substantially gear shaped boss 142 to the first face 148 of the external support 140 include welding and mechanical fasteners such as screws. A substantially gear shaped boss 142 formed as an integral part of the external support 140 is also envisioned.

It is also envisioned that the substantially gear shaped boss 142 may be created by specially cutting pieces of the same geometry as the substantially gear shaped hole 136 and affixing the specially cut pieces to the internal supports 130. It is further envisioned that the substantially gear shaped boss 142 may be created by milling the substantially gear shaped boss directly on the internal supports 130.

The substantially gear shaped hole 136 and the substantially gear shaped boss 142 are configured to mate. The substantially gear shaped boss 142 is able to be disposed in the substantially gear shaped hole 136. The repeating pattern of the teeth on the substantially gear shaped boss 142 and the substantially gear shaped hole 136 allow them to mate at multiple positions of relative rotation. The teeth on the substantially gear shaped hole 136 and substantially gear shaped boss 142 also prevent relative rotation when the substantially gear shaped hole and substantially gear shaped boss are in a mated configuration.

In an embodiment of the present invention, the ladder rung engagement rod pass-through hole 144 is a through hole disposed at the center of the substantially gear shaped boss 142. The ladder rung engagement rod pass-through hole 144 is sized to allow the ladder rung engagement rod 120 to pass freely through.

In an embodiment of the present invention, the anchor channel 146 is a substantially square tube with an inner dimension sized to allow a ground engagement member 160 to pass freely through. The anchor channel 146 is disposed on the second face 150 of the external supports 140. The anchor channel 146 is preferably disposed on the second face 150 such that an angle of approximately 45° to approximately 75° is formed between the anchor channel and the anchor support 140 as depicted by the angle X° of FIG. 4*b*. In an embodiment of the present invention, the angle formed between the anchor channel 146 and the anchor support 140 is approximately 60°. One skilled in the art would appreciate that the angle X° may be adjusted to account for different soil conditions and the angle of the ladder 10.

In a selected embodiment of the present invention, the external support 140 is approximately 5 inches by 3 inches. The substantially gear shaped boss 142 is preferably the same depth as the thickness of the internal support 130, for example, approximately ¼ inch. It is also envisioned that the substantially gear shaped boss 142 may be deeper than the thickness of the internal support 130. The rectangular plate portion of the external support 140 in a selected embodiment is approximately ¼ inch thick. The anchor channel 146 is preferably square tubing approximately 6 inches in length with an internal width of approximately ¾ inch when an approximately ½ inch to approximately ⅝ inch diameter ground engagement member 160 is utilized or with an internal width of approximately 1.25 inch when an approximately ⅞ inch diameter ground engagement member is utilized. It is also envisioned that the anchor channel 146 may have a circular internal passage and/or a non-square external geometry. In a selected embodiment, the ladder rung engagement rod pass-through hole 144 is approximately 11/16 inch in diameter.

In an embodiment of the present invention, the ground engagement members 160 are substantially U-shaped with the bend at the end opposite the ends of each ground engagement member which penetrate the soil in operation. The ground engagement members 160 are preferably comprised of cylindrical metal rod bent into the desired geometry. Steel is a non-limiting example of a metal for the ground engagement members 160. The ground engagement members 160 preferably comprise a ridged or patterned surface to engage with soil or other material into which they are disposed. The ground engagement members 160 are envisioned to be various lengths to accommodate disparate soil conditions. Non-limiting examples of lengths of ground engagement members 160 are approximately 18 inches for solid loam or clay and approximately 24 inches for sandy soils. The ground engagement members 160 are also envisioned to be various diameters with non-limiting examples including ½ inch, ⅝ inch, and ⅞ inch.

In an embodiment of the present invention, the ground engagement members 160 are substantially L-shaped with a bend at the end opposite the end of each ground engagement member which penetrates the soil in operation.

In an embodiment of the present invention, the ground engagement members 160 each comprise a cross-member connecting the individual ground penetrating spikes 152. The cross-member is believed to lessen or eliminate flaring of the ground penetrating spikes 152 after repeated impacts to force the ground engagement members 160 into the ground. The cross-member is also believed to lessen or eliminate deformation of the geometry of the ground engagement members 160 after repeated impacts to force the ground engagement members into the ground.

Referring to FIGS. 5*a*-5*d*, schematic illustrations of the extension ladder stabilizer at progressive points of installation on a generic extension ladder. In an embodiment of the present invention, the ladder stabilizer 100 may be assembled on any ladder 10 with rungs 12 which are hollow and tubular. The ladder rung engagement rod 120 is passed through a rung 12 of the ladder 10, preferably the bottom rung. The internal supports 130 are placed on the ladder 10 with the ladder rung engagement rod 120 passing through the substantially gear shaped hole 136, the internal support side plate 132 abutted against the outside face of the side rails 14, 16, and the internal support back plate 134 abutted against the back face of the side rails. One of the pair of internal supports is placed on each side rail 14, 16 respectively. The abutment of the internal support back plate 134 against the back face of the side rails 14, 16 prevents rotation of the internal support back plate and the ladder stabilizer 100 upon completion of assembly of the ladder stabilizer. One of the pair of external supports 140 are abutted against each of the internal supports 130 respectively, with the first face 148 toward the internal support. The ladder rung engagement rod 120 is passed through the ladder rung engagement rod pass-through hole 144 of each external support. When the external supports 140 are fully seated, the substantially gear shaped bosses 142 are disposed in the substantially gear shaped holes 136 of the internal supports 130 forming an interlocking engagement which prevents relative rotation. The external support 140 affixed to each side rail 14, 16 is preferably rotated prior to the substantially gear shaped boss 142 interlocking with the substantially gear shaped hole 136 to place the anchor channel 146 in the desired position. In an embodiment of the present invention, the anchor channel 146 is substantially vertical such that one open end of the anchor channel substantially faces the ground. In another embodiment of the present invention, the longitudinal axes of the anchor channels 146 are substantially parallel to the longitudinal axes of the side rails 14, 16. In a further embodiment of the present invention, the anchor channel 146 is at an approximately 45° relative to the ground. In an embodiment of thepresent invention, the internal supports 130 and the external supports 140 are securely affixed to the ladder 10 by means of a nut 162 secured to each end of the ladder rung engagement rod 120 and tightly abutted against each of the external supports on each respective side of the ladder engagement rod. In another embodiment, a washer sized to fit over the ladder rung engagement rod 120 is placed between the external support 140 and the nut 162 on each end of the ladder engagement rod. It is also envisioned that two nuts 162 are secured to each end of the ladder rung engagement rod 120. A ground engagement member 160 is then passed through each anchor channel 146 and the ground penetrating spikes 152 are driven into the ground.

In an embodiment of the present invention, the ladder stabilizer 100 may be assembled on any ladder 10, without the need for rungs 12 which are hollow and tubular. The ladder rung engagement rod 120 is passed through an orifice in each side rail 14, 16. The orifices in the side rails 14, 16 are envisioned being generated by, for example, drilling, punching, or the like. The orifices are envisioned being placed below a rung 12 such that the ladder rung engagement rod 120 is disposed proximal to the longitudinal axis of the rung. The internal supports 130 are placed on the ladder 10 with the ladder rung engagement rod 120 passing through the substantially gear shaped hole 136, the internal support side plate 132 abutted against the outside face of the side rails 14, 16, and the internal support back plate 134 abutted against the back face of the side rails. One of the pair of internal supports 130 is placed on each side rail 14, 16 respectively. One of the pair of external supports 140 are abutted against each of the internal supports 130 respectively, with the first face 148 toward the internal support. The ladder rung engagement rod 120 is passed through the ladder rung engagement rod pass-through hole 144 of each external support. When the external supports 140 are fully seated, the substantially gear shaped bosses 142 are disposed in the substantially gear shaped holes 136 forming an interlocking engagement which prevents relative rotation. The external support 140 affixed to each side rail 14, 16 is preferably rotated prior to the substantially gear shaped boss 142 interlocking with the substantially gear shaped hole 136 to place the anchor channel 146 in the desired position. In an embodiment of the present invention, the anchor channel 146 is substantially vertical such that one open end of the anchor channel substantially faces the ground. In another embodiment of the present invention, the longitudinal axes of the anchor channels 146 are substantially parallel to the longitudinal axes of the side rails 14, 16. In a further embodiment of the present invention, the anchor channel 146 is at an approximately 45° relative to the ground. In an embodiment of the present invention, the internal supports 130 and the external supports 140 are securely affixed to the ladder 10 by means of a nut 162 secured to each end of the ladder rung engagement rod 120 and tightly abutted against each of the external supports on each respective side of the ladder engagement rod. In another embodiment, a washer sized to fit over the ladder rung engagement rod 120 is placed between the external support 140 and the nut 162 on each end of the ladder engagement rod. It is also envisioned that two nuts 162 are secured to each end of the ladder rung engagement rod 120. A ground engagement member 160 is then passed through each anchor channel 146 and the ground penetrating spikes 152 are driven into the ground.

In an embodiment of the present invention, the ladder stabilizer 100 may be assembled on any ladder 10, without the need for the rungs 12 to be tubular and hollow. The internal supports 130 are placed on the ladder 10, the internal support side plate 132 abutted against the outside face of the side rails 14, 16, and the internal support back plate 134 abutted against the back face of the side rails. One of the pair of internal supports 130 is placed on each side rail 14, 16 respectively. The abutment of the internal support back plate 134 against the back face of the side rails 14, 16 prevents rotation of the internal support back plate and the ladder stabilizer 100 upon completion of assembly of the ladder stabilizer. One of the pair of external supports 140 is abutted against one of the internal supports 130 with the first face 148 toward the internal support. The other of the pair of external supports 140 is abutted against the other of the internal supports 130 with the first face 148 toward the internal support. When each of the external supports 140 are fully seated, the substantially gear shaped bosses 142 are disposed in the substantially gear shaped holes 136 forming an interlocking engagement which prevents relative rotation. The external support 140 affixed to each side rail 14, 16 is preferably rotated prior to the substantially gear shaped boss 142 interlocking with the substantially gear shaped hole 136 to place the anchor channel 146 in the desired position. In an embodiment of the present invention, the anchor channel 146 is substantially vertical such that one open end of the anchor channel substantially faces the ground. In another embodiment of the present invention, the longitudinal axes of the anchor channels 146 are substantially parallel to the longitudinal axes of the side rails 14, 16. In a further embodiment of the present invention, the anchor channel 146 is at an approximately 45° relative to the ground. The combination of the inner supports 130 and the external supports 140 may be affixed to the side rails 14, 16 directly without utilization of a ladder rung engagement rod 120. In an embodiment of the present invention, the first of the pair of internal supports 130 and the first of the pair of external supports 140 are affixed to the ladder 10 by means of a nut 162 secured to the end of a bolt passed through an orifice in side rail 14 and tightly abutted against the external support. The second of the pair of internal supports 130 and the second of the pair of external supports 140 are affixed to the ladder 10 by means of a nut 162 secured to the end of a bolt passed through an orifice in side rail 16 and tightly abutted against the external support. It is also envisioned that two nuts 162 are secured to the end of the bolts passed through the side rail 14, 16. A ground engagement member 160 is then passed through each anchor channel 146 and the ground penetrating spikes 152 are driven into the ground.

It would be recognized by one skilled in the art that there are alternate methods of affixing the internal supports 130 and external supports 140 to a ladder 10 without hollow and tubular rungs 12. Non-limiting examples include a system to clasp to the side rails 14, 16 of the ladder 10 or adhesive systems in addition to bolts as detailed previously.

Unless otherwise defined, all technical and scientific terms used herein have the same meaning as commonly understood by one of ordinary skill in the art to which the invention belongs. The terminology used in the description herein is for describing particular embodiments only and is not intended to be limiting. As used in the specification and appended claims, the singular forms "a," "an," and "the" are intended to include the plural forms as well, unless the context clearly indicates otherwise.

It is noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "approximately" is utilized herein to represent the inherent degree of uncertainty that may be attributed to any quantitative comparison, value, measurement, or other representation. The term "approximately" is also utilized herein to represent the degree by which a quantitative representation may vary from a stated reference without resulting in a change in the basic function of the subject matter at issue.

While certain representative embodiments and details have been shown for purposes of illustrating the invention, it will be apparent to those skilled in the art that various changes may be made without departing from the scope of the invention, which is defined in the appended claims.

What is claimed is:

1. An extension ladder stabilizer comprising:

a pair of ground engagement members, each having two legs;

a ladder rung engagement rod comprising threads along at least a portion of the length of the ladder rung engagement rod disposed in and projecting from each end of a hollow tubular rung of an extension ladder;

a pair of rectangular internal support side plates, each having a substantially gear shaped aperture and interfacing with a side rail of an extension ladder;

a pair of rectangular external support plates comprising a substantially gear shaped boss on a first face, a hole located substantially in the center of the substantially gear shaped boss receiving said ladder rung engagement rod, and an anchor channel disposed on a second face opposite the first face, respectively, wherein the anchor channels each comprise a straight tube receiving one leg of said ground engagement member;

wherein the substantially gear shaped boss of the external support plate is disposed in the substantially gear shaped aperture of the internal support side plate to form an interlocking arrangement between said external support plate and said internal support side plate, facilitating the positioning of said anchor channel relative to said internal support side plate, and inhibiting rotation of said external support plate relative to said internal support said plate.

2. The extension ladder stabilizer of claim 1, wherein said ground engagement members are at least 18 inches in length.

3. The extension ladder stabilizer of claim 1, wherein the substantially gear shaped boss and substantially gear shaped aperture each comprise 10 to 15 teeth.

4. The extension ladder stabilizer of claim 1, wherein the teeth of the substantially gear shaped boss and substantially gear shaped aperture are isosceles trapezoidal.

5. The stabilizer of claim 1, wherein said anchor channel is disposed on said external support plate at an angle of 45 degrees to 75 degrees to the latitudinal axis of said plate.

6. The stabilizer of claim 1, wherein said internal support side plate further comprises an internal support back plate, extending perpendicular from one end of said internal support side plate.

7. The stabilizer of claim 1, wherein said internal support side plate is disposed within an outside channel of a ladder side rail.

8. The stabilizer of claim 1, wherein the gear shaped aperture of the internal support side plate is positioned so that the center thereof is along the longitudinal axis of said internal support side plate.

9. An extension ladder stabilizer comprising:

a pair of ground engagement members;

a ladder rung engagement rod comprising threads along at least a portion of the length of the ladder rung engagement rod disposed in and projecting from each end of a hollow tubular rung of an extension ladder;

a pair of internal support side plates each interfacing with a side rail of an extension ladder, respectively;

a pair of rectangular external support plates comprising a straight substantially square tube disposed on a face of said plate through which one of the ground engagement members passes; and wherein the internal support plates and the external support plates form an interlocking arrangement by means of a boss having teeth around the exterior circumference thereof to form a gear shape on said external support plate, and an engaging aperture on said internal support plate having corresponding teeth cut into the circumference of said aperture, said gear shaped boss having an aperture therethrough to receive said ladder rung engagement rod.

10. The stabilizer of claim 9, wherein said square tube is disposed on said external support plate at an angle of 45 degrees to 75 degrees to the latitudinal axis of said external support plate.

11. The stabilizer of claim 9, wherein said internal support side plate further comprises an internal support back plate extending perpendicular from one end of said internal support side plate.

12. The stabilizer of claim 9, wherein said internal support side plate is disposed within an outside channel of a ladder side rail.

13. The stabilizer of claim 9, wherein the gear shaped aperture of the internal support side plate is positioned so that the center thereof is along the longitudinal axis of said internal support side plate.

14. An extension ladder stabilizer comprising:

a pair of ground engagement members having at least one leg;

a pair of internal support side plates comprising a substantially gear shaped aperture interfacing with at least two faces of a side rail of an extension ladder, respectively;

a pair of rectangular external support plates each comprising a substantially gear shaped boss on a first face, a hole located substantially in the center of the substantially gear shaped boss receiving a bolt, and an anchor channel disposed on a second face opposite the first face, respectively, wherein the anchor channel comprises a straight tube receiving a leg of one of the ground engagement members; and wherein the the substantially gear shaped boss of the external support plate is disposed in the substantially gear shaped aperture of the internal support side plate to form an interlocking arrangement between said external support plate and said internal support side plate, facilitating the positioning of said anchor channel relative to said internal support side plate, and inhibiting rotation of said external support plate relative to said internal support side plate, and wherein the first of the pair of internal supports and the first of the pair of external supports are affixed to a ladder by means of a nut secured to the end of a first bolt passed through an orifice in the side rail of the ladder and tightly abutted against the first external support or a washer and the second of the pair of internal supports and the second of the pair of external supports are affixed to the ladder by means of a second nut secured to the end of a second bolt passed through an orifice in the side rail of the ladder and tightly abutted against the second external support or a washer.

15. The stabilizer of claim 14, wherein said anchor channel is disposed on said external support plate at an angle of 45 degrees to 75 degrees to the latitudinal axis of said external support plate.

16. The stabilizer of claim 14, wherein said internal support side plate further comprises an internal support back plate, extending perpendicular from one end of said internal support side plate.

17. The stabilizer of claim 14, wherein said internal support side plate is disposed within an outside channel of a ladder side rail.

18. The stabilizer of claim 14, wherein the gear shaped aperture of the internal support side plate is positioned so that the center thereof is along the longitudinal axis of said internal support side plate.

19. The stabilizer of claim 14, wherein the ground engagement members are L-shaped.

20. The stabilizer of claim 14, wherein the ground engagement members each comprise two ground penetrating spikes and a cross member connecting said spikes.

* * * * *